US006609639B1

(12) United States Patent
Genthon

(10) Patent No.: US 6,609,639 B1
(45) **Date of Patent: *Aug. 26, 2003**

(54) DRIP PREVENTION APPARATUS

(76) Inventor: John Genthon, 151 ter, rue Joliot Curie, 69005 Lyon (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/647,993

(22) PCT Filed: Mar. 16, 1999

(86) PCT No.: PCT/FR99/00582

§ 371 (c)(1),
(2), (4) Date: Nov. 14, 2000

(87) PCT Pub. No.: WO99/47427

PCT Pub. Date: Sep. 23, 1999

(30) Foreign Application Priority Data

Mar. 16, 1998 (FR) ..... 98 03392

(51) Int. Cl.[7] ..... B65D 25/40

(52) U.S. Cl. ..... 222/571; 222/569; 222/568; 222/567

(58) Field of Search ..... 222/567, 571, 222/542, 568, 569

(56) References Cited

U.S. PATENT DOCUMENTS

| | | | | | |
|---|---|---|---|---|---|
| 1,966,611 | A | * | 7/1934 | Cobel | 259/72 |
| 2,134,281 | A | * | 10/1938 | Illch | 215/73 |
| 2,785,841 | A | * | 3/1957 | Westgate | 222/545 |
| 2,788,161 | A | * | 4/1957 | Kemper | 222/571 |
| 2,848,145 | A | * | 8/1958 | Livingstone | 222/542 |
| 3,434,637 | A | * | 3/1969 | Marcel | 222/570 |
| 3,491,924 | A | * | 1/1970 | Bloomfield et al. | 222/567 |
| 3,491,925 | A | * | 1/1970 | Sundgren | 222/571 |
| 3,926,348 | A | * | 12/1975 | Lutzker | 222/189 |
| 4,349,056 | A | * | 9/1982 | Heino | 141/381 |
| 4,433,800 | A | * | 2/1984 | Owens | 222/547 |
| 4,591,078 | A | * | 5/1986 | Weissman | 222/517 |

FOREIGN PATENT DOCUMENTS

| | | | | |
|---|---|---|---|---|
| CA | 1 200 792 | | 2/1986 | |
| CH | 620874 | A5 * | 12/1980 | ..... B65D/47/40 |
| DE | 859 714 | | 4/1952 | |
| FR | 941 772 | | 2/1949 | |
| FR | 972 279 | | 1/1951 | |

* cited by examiner

*Primary Examiner*—Ehud Gartenberg
*Assistant Examiner*—Frederick Nicolas
(74) *Attorney, Agent, or Firm*—Oliff & Berridge, PLC

(57) ABSTRACT

A non-drip device or drip prevention apparatus eliminates all liquid dripping. The device includes a body with an orifice wherein the neck of a container may be inserted, a shoulder and a planar surface maintaining a joint in a recess. When the non-drip device is attached by interlocking, the planar surface acts as end of travel stop indicating that the attachment is completed. An angle associated with a quarter circle facilitates liquid reinsertion into the bottle. A diameter of the device enables the liquid to flow rapidly when poured and a ridge interrupts the liquid flow after it has been served. An overlap is provided for publicity or a print. The non-drip device is designed to eliminate dripping, for example, when wine is poured from a bottle.

15 Claims, 3 Drawing Sheets

DRIP PREVENTION APPARATUS

BACKGROUND OF THE INVENTION

1. Field of Invention

The drip prevention apparatus of this invention provides a feeling of comfort when serving any liquid of different viscosity, by preventing any of this liquid from dripping down the outside of a dispensing container.

2. Description of Related Art

How many of us have thought to protect our tablecloth from drips of various liquids?

It is often the case in fact, when serving wine or alcohol from a conventional 75-centiliter wine bottle, that one or more drips ruin a meticulous presentation.

As will have been observed, a drop of wine always tends to spread out upon contact with a cotton or polycotton fabric, or even on contact with paper. The only solution to this is to wash it.

SUMMARY OF THE INVENTION

Effectiveness and esthetic appearance should be married to appeal to the greatest number of people. This invention meets these criteria.

The drip prevention apparatus comprises, in a first version, a body at which a food-grade seal allows attachment to the neck of the wine bottle. The body has an interior orifice that allows the passage of the liquid, and a slope that allows the liquid to return easily to the inside of the bottle. The body may also comprise an inside diameter associated with an edge for rapidly cutting off the flow of liquid and/or a flat part acting as a stop on the top of the neck of the wine bottle as the drip prevention apparatus is fixed thereon.

This device may be fixed to the outside of the neck, so that it does not in any way alter the flow of liquid while it is in use, and light pressure on the top of the device allows it to be fixed to the neck where no effect is elicited.

In a second version, the invention comprises a body similar to the previous one, the difference lying in the fact that this drip prevention apparatus is designed to be used on bottles with a threaded neck. A tapping is made inside the drip prevention apparatus so that the threaded neck and the device can fit together.

In a third version, the invention may comprise a body similar to either one of the previous versions, but with a threaded outer ring that allows the drip prevention apparatus to be capped.

Examinations of the various parts of the drip prevention apparatus will reveal points liable to elucidate this invention.

A particular method of manufacture of the drip prevention apparatus may be employed.

An orifice of different diameter will allow entry into the neck.

A shoulder of different thickness and different diameter may be created.

A seal may be provided, with a width and thickness that vary according to the model, for better grip.

A flat part may be provided, with a width and thickness which vary according to the model, to provide a better limit stop. This same device may have a slope with different angles.

A liquid-flow diameter may be adjustable to give better operation.

An edge for cutting off the liquid may differ according to the model.

Fillets may be provided for better effectiveness.

A tapping at the bottom of the device may be created, so that the device can be fitted onto threaded bottle necks with a rounded thread.

A threaded outer ring may be provided, depending on the model, so that the device can be completely capped.

A cap may be provided, to give a perfect seal.

At the bottom of the device, a surface may be provided for covering the neck and advertising may be affixed thereto.

BRIEF DESCRIPTION OF DRAWINGS

The drawings appended hereto illustrate various embodiments of the invention.

FIG. 6 depicts, in section, a drip prevention apparatus according to a fifth embodiment of the invention.

DETAILED DESCRIPTION OF PREFERRED EMBODIMENTS

Figure 1:
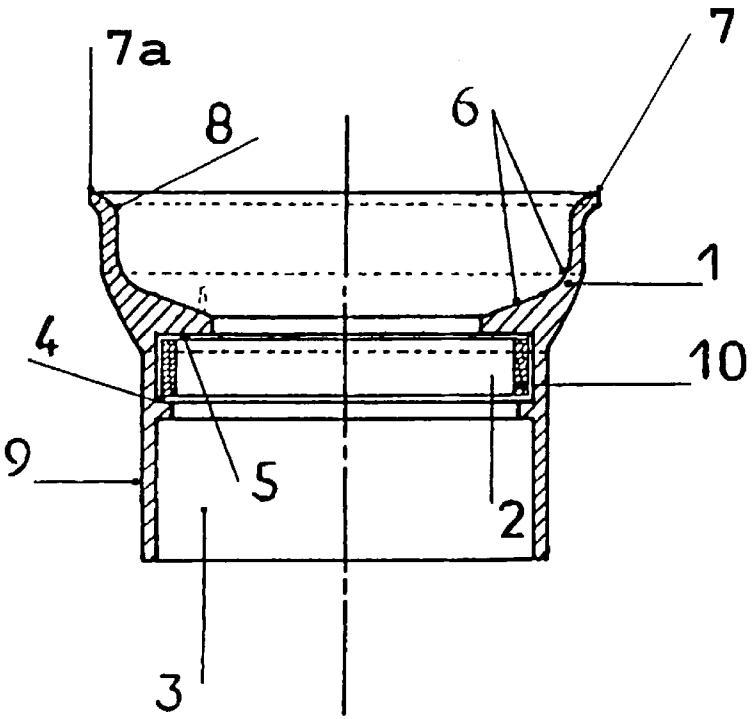
FIG. 1 depicts, in section, a drip prevention apparatus according to a first embodiment of the invention.

With reference a first embodiment shown in FIG. 1, a drip prevention apparatus comprises a body 1 molded in food-grade polypropylene or made of food-grade stainless steel, a groove 2 for holding in place a food-grade silicone seal 10 between a shoulder 4 and a flat surface of a stop 5 to ensure a firm hold on the neck.

The flat surface of the stop 5 will have an end-of-travel function when the drip prevention apparatus is fixed on a neck of, for example, a wine bottle. An angle associated with a rounded angle or fillet 6, which can be modified, may be provided to make it easier for the liquid to return to the bottle after dispensing. Associated with the fillet 6 is an inside liquid-flow diameter 8. The diameter 8, which can be modified, is followed by a slope that encourages the liquid to flow to the outside. Added to the slope is a liquid cutoff 7*a* at a circumferential lip 7 that will cut off the liquid when dispensing is halted. As far as esthetics are concerned, a cover piece 9 extending from the shoulder 4 over the neck of the bottle may be provided. An orifice 3 allows the drip prevention apparatus to be introduced onto the neck of the bottle and the liquid to pass through the body 1.

Figure 3:
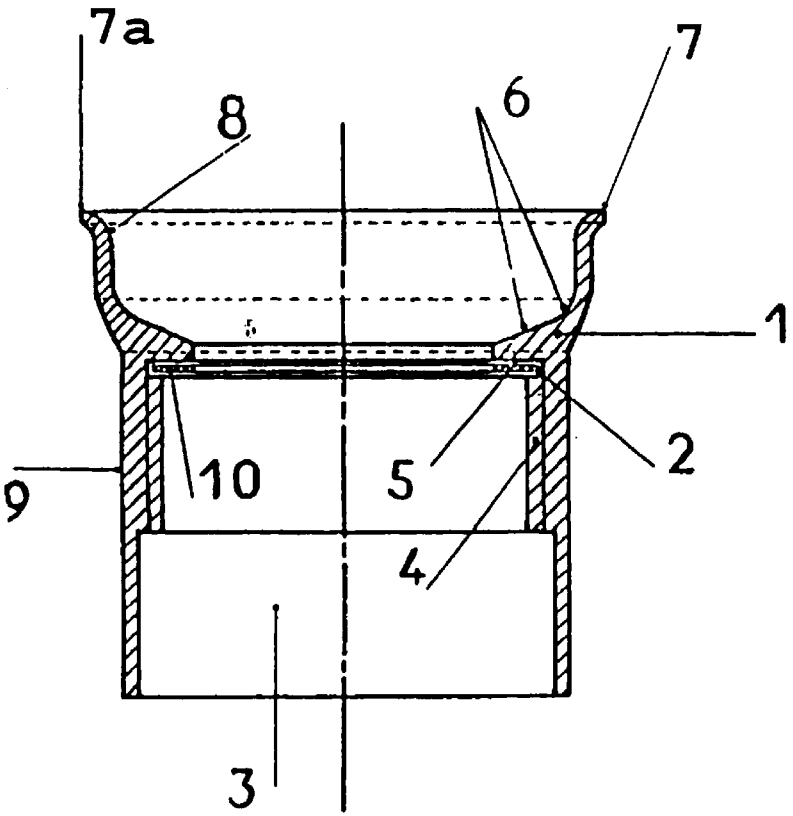
FIG. 3 depicts, in section, a drip prevention apparatus according to a second embodiment of the invention, with a system allowing the drip prevention apparatus to be screwed onto threaded necks with rounded threads.

With reference to a third embodiment shown in FIG. 3, a tapped thread 4 is provided on the inside of the liquid drip prevention apparatus. The tapped thread 4 allows the drip prevention apparatus to be fitted onto threaded necks, for example, with rounded threads.

With the exception of the tapped thread 4, which is generally undesirable in the push-on drip prevention apparatus of FIG. 1, all the functions of the drip prevention apparatus of the first embodiment may be incorporated in the third embodiment.

Figure 2:
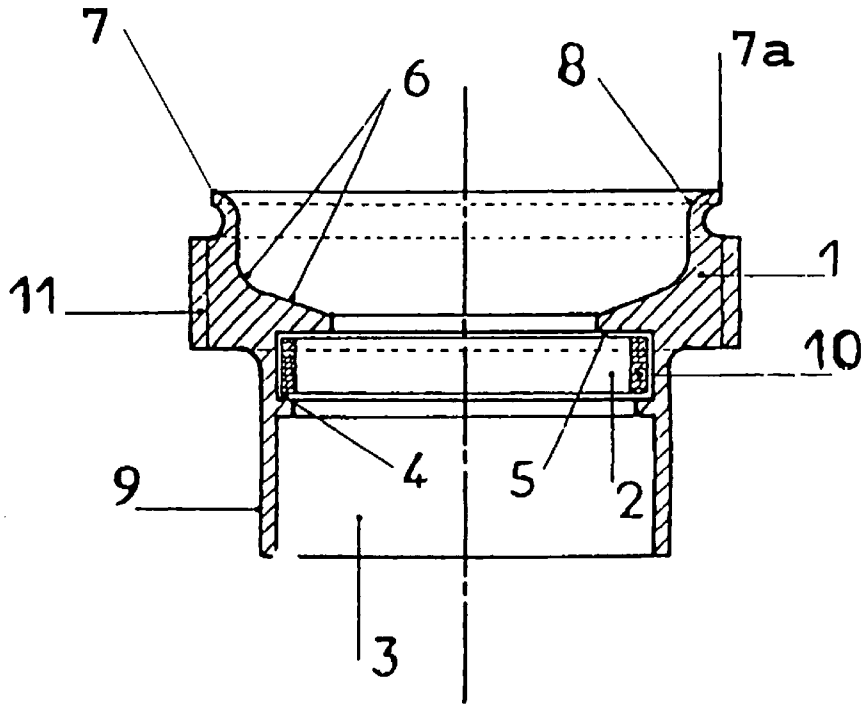
FIG. 2 depicts, in section, a drip prevention apparatus according to a third embodiment of the invention, with an outer ring for capping.
Figure 4:
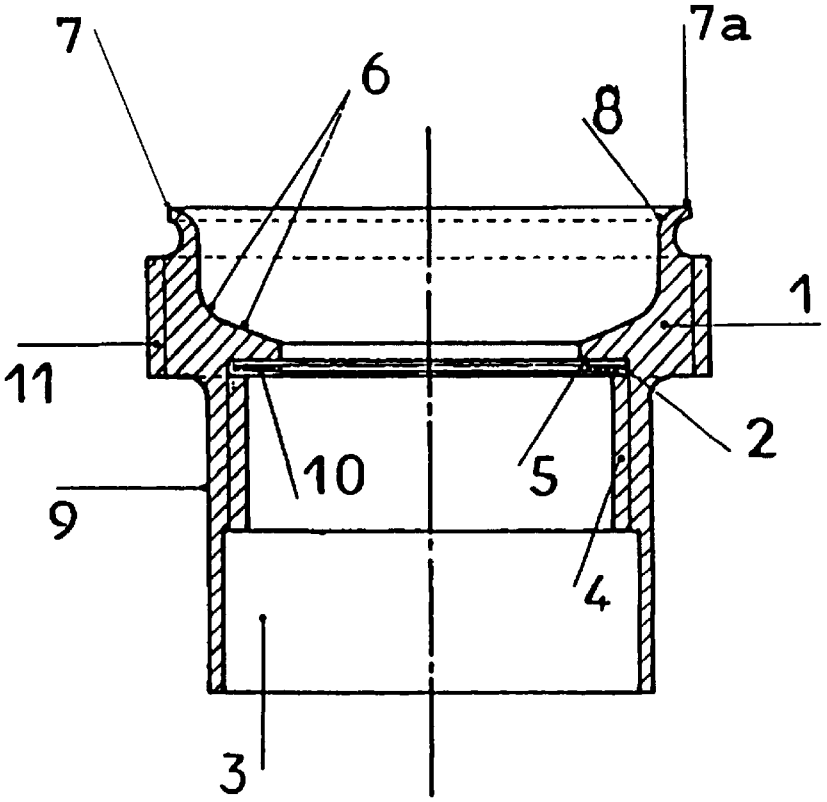
FIG. 4 depicts, in section, a drip prevention apparatus according a fourth embodiment of the invention, with a system allowing the drip prevention apparatus to be screwed onto threaded necks with rounded threads and having an outer ring for capping.
Figure 5:
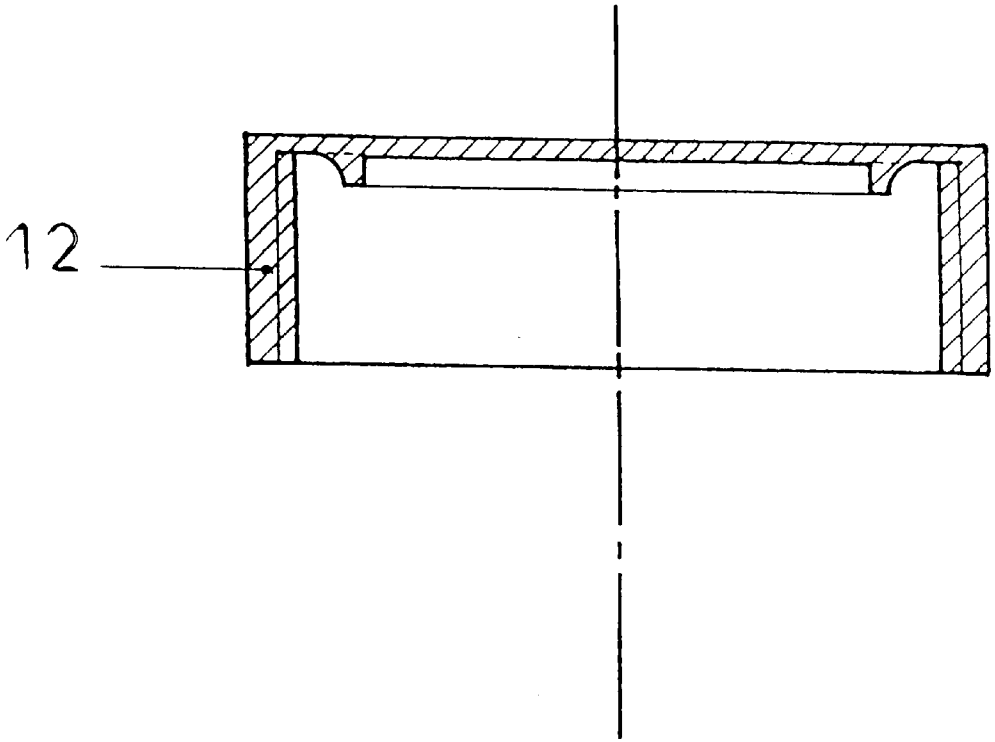
FIG. 5 depicts, in section, a cap used for capping the drip prevention apparatus according to FIGS. 2 and 4.

With reference to a second embodiment shown in FIGS. 2 and 4, a ring with a rounded thread 11 allows the drip prevention apparatus to have a cap 12, shown in FIG. 5, to make the bottle secure. The cap 12 may be made of food-grade polypropylene or of food-grade stainless steel, and may completely seal the drip prevention apparatus and the bottle.

For example, a drip prevention apparatus for wine bottles may, non-limitingly, have dimensions of 28 mm in height, 40 mm pouring diameter, and 32 mm diameter for covering the neck of the bottle.

The wine drip prevention apparatus with the ring 11 and the cap 12 may, for example, have a capping outside diameter on the order of 45 mm.

According to one method of manufacture and depending on the overall cost, the drip prevention apparatus may be made of plastic, such as food-grade polypropylene, or of food-grade stainless steel, as may the cap which seals the apparatus. Any other material may supplement the method of manufacture. For mass production, molding will allow for a single injection-molding operation with a built-in seal. For special marketing, the drip prevention apparatus may be made of food-grade stainless steel. Further, the drip prevention apparatus may have a cover piece which may bear personalized advertising inscriptions. Preferably, there will be no risk of cutting and no risk of breakage even after an impact.

For highly specialized orders, the drip prevention apparatus may be made of gold or glass. Also, the manufacture of bottles integrated with the drip prevention apparatus may be envisaged. This would limit the additional costs inherent in performing two separate and/or different methods. The drip prevention apparatus design is not restricted to table service, but extends to all kinds of industry using liquids and concerned about protecting persons or things from drips. For example, the pharmaceutical industry is contemplated since this method marries effectiveness with reliability in the pouring of liquids.

In particular, the drip prevention apparatus according to the invention is intended for the general public likely to drink wine, champagne, or any other liquid.

What is claimed is:

1. A drip prevention apparatus, comprising:

a body with an orifice through which liquid from a container may pass;

a circumferential lip defined at an outer edge of the body;

an inner surface of the body with a smooth profile, without any protruding or cutting edge, that extends from the circumferential lip to the orifice;

a rounded angle within the profile that acts as a reservoir such that an amount of liquid remaining in the reservoir during dispensing of liquid returns to the container and prevents a drip upon completion of dispensing;

an end-of-travel stop that limits the travel of the body when the body is attached to a neck of the container; and a seal adjacent the end-of-travel stop.

2. The apparatus of claim 1, further comprising a shoulder that forms part of the body, the shoulder located on a side of the seal opposite the end-of-travel stop to hold the seal in place.

3. The apparatus of claim 1, further comprising a groove in which the seal is disposed, wherein the end-of-travel stop comprises a flat part that limits the travel of the body when the body is attached to a neck of the container and keeps the seal in the groove.

4. The apparatus of claim 1, further comprising a substantially constant liquid-flow diameter.

5. The apparatus of claim 1, wherein the circumferential lip comprises a non-protruding and non-cutting edge that provides a break-off point for a drop of liquid.

6. The apparatus of claim 1, further comprising a tapping formed in the body adjacent the seal opposite the end-of-travel stop, the tapping being adapted to attach the body to a threaded neck of the container.

7. The apparatus of claim 1, further comprising an outer ring with a thread that is adapted to attach a cap to the body.

8. The apparatus of claim 1, further comprising a cap that is arranged to completely seal a liquid in a container from atmosphere when the body is attached to a neck of the container.

9. The apparatus of claim 1, further comprising a cover piece adjacent the seal opposite the end-of-travel stop that is arranged to cover a neck portion of the container when the body is attached to a neck of the container.

10. A drip prevention apparatus, comprising:

a body with an orifice through which liquid may pass;

a container with an opening at which the body is integrally formed;

a circumferential lip defined at an outer edge of the body;

an inner surface of the body with a smooth profile, without any protruding or cutting edge, that extends from the circumferential lip to the orifice;

a rounded angle within the profile that acts as a reservoir such that an amount of liquid remaining in the reservoir during dispensing of liquid returns to the container and prevents a drip upon completion of dispensing;

an end-of-travel stop that limits the travel of the body when the body is attached to a neck of the container; and a seal-adjacent the end-of-travel stop.

11. The apparatus of claim 10, wherein the container has a neck leading to the opening and the body does not alter flow of a liquid through the neck.

12. The apparatus of claim 10, further comprising a substantially constant liquid-flow diameter.

13. The apparatus of claim 10, wherein the circumferential lip comprises a non-protruding and non-cutting edge that provides a break-off point for a drop of liquid.

14. The apparatus of claim 10, further comprising an outer ring with a thread that is adapted to attach a cap to the body.

15. The apparatus of claim 10, further comprising a cap that is arranged to completely seal a liquid in the container from atmosphere.

* * * * *